US005981058A

United States Patent [19]

Shih et al.

[11] Patent Number: 5,981,058

[45] Date of Patent: Nov. 9, 1999

[54] STAIN BLOCKING BARRIER LAYER

[75] Inventors: Keith S. Shih, Harriman, N.Y.; Hao A. Chen, Chadds Ford, Pa.

[73] Assignee: Mannington Mills, Inc., Salem, N.J.

[21] Appl. No.: 08/713,422

[22] Filed: Sep. 13, 1996

[51] Int. Cl.[6] ..... B32B 27/34; B32B 27/40

[52] U.S. Cl. ..... 428/335; 428/46; 428/47; 428/48; 428/337; 428/423.5; 428/424.6; 428/475.8; 428/476.3; 428/904.4

[58] Field of Search ..... 428/220, 337, 428/335, 423.5, 474.4, 475.5, 904.4, 424.6, 475.8, 476.3, 44, 46, 47, 48; 442/326

[56] References Cited

U.S. PATENT DOCUMENTS

| | | | |
|---|---|---|---|
| 2,285,009 | 6/1942 | Brubaker et al. | 528/329.1 |
| 2,320,088 | 5/1943 | Leekley | 524/169 |
| 2,388,035 | 10/1945 | Frosch | 528/340 |
| 2,393,972 | 2/1946 | Cairns | 264/184 |
| 2,450,940 | 10/1948 | Cowan et al. | 564/138 |
| 2,962,390 | 11/1960 | Fain et al. | 428/429 |
| 3,336,415 | 8/1967 | Kennedy | 428/458 |
| 3,462,337 | 8/1969 | Gorton | 156/330 |
| 3,567,536 | 3/1971 | Wickersham, Jr. | 156/78 |
| 3,636,136 | 1/1972 | Konopik | 525/58 |
| 3,637,550 | 1/1972 | Sprauer | 525/420 |
| 4,104,438 | 8/1978 | Angelo et al. | 428/332 |
| 4,277,427 | 7/1981 | Kaminski et al. | 264/45.5 |
| 4,772,500 | 9/1988 | Stroppiana | 428/46 |
| 4,794,020 | 12/1988 | Lussi et al. | 427/195 |
| 4,879,148 | 11/1989 | Neaves et al. | 428/41.8 |
| 4,880,701 | 11/1989 | Gibbons et al. | 428/34.2 |
| 4,911,061 | 3/1990 | Pivitt et al. | 89/36.02 |
| 5,015,516 | 5/1991 | Lussi et al. | 428/143 |
| 5,082,708 | 1/1992 | Kauffman et al. | 428/47 |
| 5,286,555 | 2/1994 | Reed | 442/60 |
| 5,290,591 | 3/1994 | Lussi et al. | 427/202 |
| 5,308,694 | 5/1994 | Andersson | 428/331 |
| 5,352,499 | 10/1994 | Willard | 428/35.7 |

*Primary Examiner*—D. S. Nakarani
*Attorney, Agent, or Firm*—Finnegan, Henderson, Farabow, Garrett, and Dunner, L.L.P.

[57] ABSTRACT

The present invention is directed to a barrier layer which has the ability to substantially prevent the diffusion of stains, such as plasticizers and dyes or other chemicals, onto a surface of a surface covering, from a surface or object in which the surface covering is placed upon. The barrier layer contains a polyamide or polyurethane and is preferably located above a substrate or base layer in a surface covering. The barrier layer preferably is located between a UV topcoat layer and a vinyl wear layer. The present invention also relates to a method of preventing stain migration onto a surface covering from a surface on which the surface covering is placed by use of the barrier layer of the present invention and also relates to methods of making surface coverings containing the barrier layer of the present invention.

10 Claims, 2 Drawing Sheets

STAIN BLOCKING BARRIER LAYER

BACKGROUND OF THE INVENTION

The present invention relates to a stain blocking barrier layer for use in surface covering products and a method for making the surface covering products (e.g., decorative inlaid floor coverings and wallpaper) containing the barrier layer. More particularly, the present invention relates, in part, to a stain blocking barrier layer capable of preventing stains, such as dyes, from diffusing from a surface on which the surface covering is placed, or topical stains resulting from contact on the surface of the covering.

Current surface coverings such as vinyl flooring, consistently have the problem of stains diffusing from a surface, such as a sub-floor or floor mat located on or beneath the surface covering, onto and through the surface covering to the extent the stain is undesirably visual to the consumer. The cause of such stains can be, for example, coated nails, ink markers, adhesives, pens, wood extractives, or dyes. To date, prevention of the migration of stains has not been effective and there is a need to develop a stain blocking product for surface coverings which will effectively block the diffusion of such stains from a lower surface.

SUMMARY OF THE INVENTION

A feature of the present invention is to provide a stain blocking barrier layer to be incorporated into surface covering products which will prevent the diffusion of stains onto and through the surface covering from a surface or object located directly on or beneath the surface covering.

An additional feature of the present invention is to provide a process for making surface covering products containing the stain blocking barrier layer of the present invention.

Additional features and advantages of the present invention will be set forth in part in the description which follows, and in part will be apparent from the description, or may be learned by practice of the present invention. The objectives and other advantages of the present invention will be realized and attained by means of the elements and combinations particularly pointed out in the written description including the drawings and appended claims.

To achieve these and other advantages and in accordance with the purpose of the present invention, as embodied and broadly described herein, the present invention relates to a stain blocking barrier layer for use in surface covering products. The stain blocking barrier layer contains at least one polyamide or polyurethane compound capable of substantially preventing stain diffusion through a surface covering.

The present invention also relates to surface coverings containing these barrier layers or coatings of the present invention.

Additionally, the present invention relates to a method of preventing stain diffusion through surface coverings by including, as part of the surface covering, a barrier layer or coating of the present invention.

Lastly, the present invention relates to a method of providing surface coverings containing the barrier layer which includes the step of applying the barrier layer or coating of the present invention.

It is to be understood that both the foregoing general description and the following detailed description are exemplary and explanatory only and are intended to provide further explanation of the present invention, as claimed.

The accompanying drawings, which are incorporated in and constitute a part of this specification, illustrate embodiments of the present invention and together with the description, serve to explain the principles of the present invention.

Figure 1:
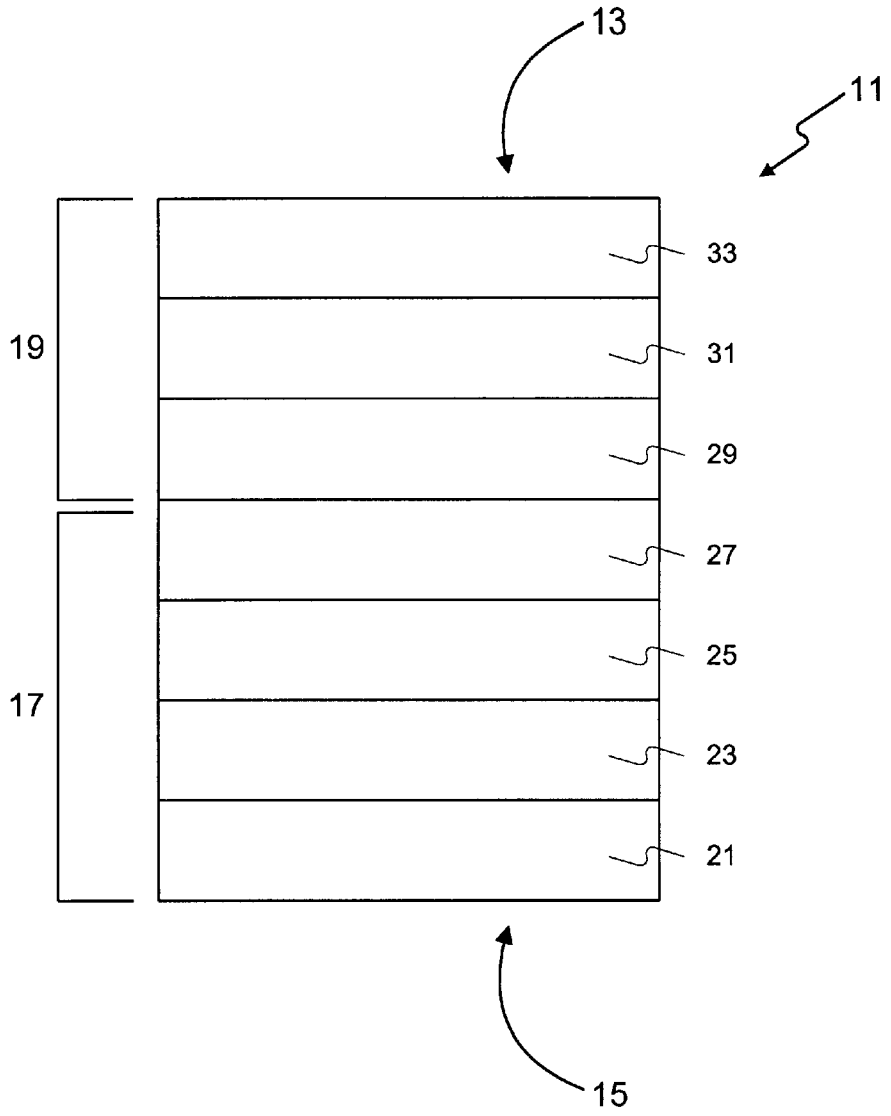
FIGS. 1–3 show cross-sectional views of surface coverings constructed according to the teachings of various embodiments of the present invention.

It will be appreciated that where a particular layer from FIG. 1 is repeated in subsequent figures, the repeated layer shown in the subsequent figure will retain the same corresponding numeral as that of FIG. 1. It will also be appreciated that in the figures, the dimensions of the various features are not to scale.

DETAILED DESCRIPTION OF THE PRESENT INVENTION

Reference will now be made in detail to the embodiments of the present invention, including preferred aspects, examples of which are illustrated in the accompanying drawings. Wherever possible, the same reference numerals will be used throughout the drawings to refer to the same or like parts.

Without wishing to be bound by any theory, the principles of explaining the barrier properties of polyamide or polyurethane (PU) materials that are capable of blocking the common stainants from diffusion through the flooring products are a high glass transition temperature and crystalline structure and crosslinked structure. For example, the plasticized PVC materials typically used for the floor have a relative low glass transition temperature (e.g., 20° C.) and an amorphous structure. At ambient conditions, the polymer chains are mobile with free motion. The behavior of absorption and diffusion of low-molecular-weight monomeric species such as stainants through the polymer matrix are quite rapid due to internal micromotions of chain rotation and translation, as well as vibration. Basically, a larger amount of free volume allows small molecules diffusion through a polymeric matrix by jumping into transient holes in the polymer structure. To the extent the polymer molecules are flexible and their segments are in thermal motion, the location of these holes moves randomly like Brownian motion. The small diffusing molecules can jump from one hole to the other, move with the gradient from high to low concentrations, and thus produce diffusion and permeation through the polymeric material.

Without wishing to be bound by any theory, it is believed that the glass transition temperature of the polyamide materials is about 50° C. and the polymer structure is somewhat crystalline. At ambient conditions, the polyamide material is in its glassy state. The glassy behavior of polyamides means a hard, rigid material and the polyamides restrict chain mobility because of strong intermolecular forces between backbone chains. With crystallinity, polyamides make the film very dense in structure and leaves very little internal void space. Hence, the diffusivities of any potential penetrant through such a structure are low.

For purposes of the present invention, a surface or object located directly on or beneath a surface covering includes, but it not limited to, sub-flooring, walls, underlayment, plaster, nails, staples, and stains on the surfaces or objects, such as dyes, asphalt, ink, driveway sealer, wood extractives, primers, shoe polish, and the like. The term surface covering is meant to include, but not be limited to, floor coverings, wall and ceiling coverings, countertops, laminates, and any other surface to be covered with decorative surface coverings. Specific examples of surface coverings would include, but not be limited to, wallpaper, vinyl inlaid floors, and the like.

Generally, any polyamide or polyurethane polymer having the ability to prevent substantial stain diffusion onto a surface covering from a surface or object located directly on or beneath the surface covering is suitable as a barrier layer or coating for the present invention.

Preferably, the polyamide compound is soluble in alcohol or is dispersed in water, or alcohol-water mixtures. These include the polyamide polymers described in U.S. Pat. Nos. 2,285,009; 2,320,088; 2,388,035; 2,393,972; and 2,450,940, all incorporated in their entirety by reference herein. A particularly preferred polyamide polymer is a special grade of polyamide copolymer sold under the tradename Elvamide® from DuPont. This polyamide polymer is soluble in alcohol or alcohol-water mixtures. The polyamide coating is also preferably an about 5% by weight to an about 25% by weight solid solution in alcohol, such as ethanol. Most preferably, the polyamide coating is an about 10% by weight solid solution in alcohol, preferably ethanol.

In some instances, while the polyamide polymer is an excellent stain blocker or barrier, the adherence of the polyamide to various layers of a surface covering, such as a vinyl layer, may not be satisfactory for commercial use. Accordingly, in such instances, an adhesion promoter, also known as a primer or a tie coat, may be used, where the adhesion promoter is coated on both sides (e.g. top and bottom) of the barrier layer. A preferred adhesion promoter is a water borne polyurethane dispersion available from Stahl Chemical under the designation MPC-508. The preferred adhesion promoter contains an aliphatic polyurethane made out of aliphatic polycarbonate polyol and an aliphatic di-isocyanate. The adhesion promoter also preferably includes a polyurethane based adhesive, as well as a cross-linker such as a melamine cross-linker available from Monsanto, CYTEC, or Stahl under the designation XR-9174. Preferably, about 120 to about 180 parts by weight, more preferably about 160 parts by weight, of an aliphatic polyurethane; about 20 parts by weight to about 60 parts by weight, more preferably about 40 parts by weight, of a polyurethane based adhesive; and about 3 parts by weight to about 10 parts by weight, more preferably about 6 parts by weight, of a cross-linker, preferably a melamine cross-linker are present in the adhesion promoter. Parts by weight is based on total weight of each component.

The optional use of an adhesion promoter as described above is typically coated above and below the polyamide barrier layer to increase its adhesion between the various layers of a surface covering. The primer or adhesion promoter layer is very thin, for instance about 0.10 mil. The adhesion promoter can be applied in any fashion known to those skilled in the art. For example, the adhesion promoter is coated by roto-gravure printing techniques. A thicker adhesion promoter coating (e.g., from about 0.30 mil to about 0.50 mil) is sometimes needed when coating a felt backing layer due to the porous nature of the felt. When used, the adhesion promoter layer in contact with the base layer is cured at a sufficient temperature and time to ensure free tackiness, for instance in a convection oven at about 200° F. to about 300° F. for about 1 minute to about 2 minutes. The polyamide barrier layer can then be applied on top of the adhesion promoter layer. The polyamide barrier layer generally has a dry film thickness of at least about 0.30 mil and preferably from about 0.40 mil to about 0.60 mil. The polyamide barrier layer can be coated with a No. 20 or No. 30 Myer rod. Like the polyurethane barrier layer coating described below, the polyamide coating can be similarly dried to remove any water (e.g., with the use of a Blue-M oven at about 200° F. to about 300°0 F. for about 1 minute to about 2 minutes). After the polyamide film is dried, a second adhesion promoter coating can then be coated on the top or upper side of the polyamide using the same curing conditions as in the first adhesion promoter layer. Afterwards, the pre-gel layer or foam layer can be applied followed by a clear wear layer, for example, using techniques and materials known to those skilled in the art.

Another type of barrier layer or coating that can be used is a polyurethane film or coating. The polyurethane coating is preferably an about 25 to about 50 percent by weight solid dispersion in water. Preferably, the polyurethane is an aliphatic urethane and is preferably obtained from a reaction of an aliphatic polycarbonate polyol and an aliphatic di-isocyanate. One preferred polyurethane coating is from Stahl U.S.A. under the designation EX-51224. The polyurethane coating or barrier layer also preferably contains a cross-linker, such as a melamine cross-linker from Monsanto, CYTEC or the XR-9174 cross-linker from Stahl. Generally, from about 2 wt % to about 10 wt % of a cross-linker is present, when used as part of the polyurethane barrier layer.

Preferably, the polyurethane barrier layer has a dry film thickness of from about 0.3 mil to about 3.0 mil, preferably from about 0.8 mil to about 1.8 mil. The polyurethane coating can be applied in any manner. For instance, the polyurethane can be coated with a Myer rod, such as No. 20 or No. 30. The wet film polyurethane coating can then be cured, for instance, by placing the wet film in a convection oven (e.g., Blue M, available from Blue M Company at Blue Island, Ill.) at a sufficient temperature for a sufficient time to completely remove the water existing in the coating. Typically, about 200° F. to about 300°0 F. for about 1 minute to about 2 minutes is preferred to completely remove the water existing in the polyurethane coating. Preferably, this coating should not be overcured to insure adhesion to the neighboring layer.

In the context of a surface covering, the barrier layer of the present invention can be located anywhere in the surface covering to prevent the migration of stains originating from a surface or object in contact with the surface covering. For example, the barrier layer can be located immediately above the base layer also commonly known as the felt backing layer or vinyl backing layer in floor coverings.

Placed immediately on top of the surface of the barrier layer not in contact with the base layer is preferably a pre-gel which is PVC-plastisol containing a chemically blowing agent derived into foam during fusion. On top of the pre-gel layer is a design layer printed by gravure press or other means. On top of the printed layer is a clear wear layer which is fused wherein the pre-gel layer foams up during the fusion process. On top of the clear wear layer can be a UV-curable urethane top coat. The surface covering can have any number of various layers and the barrier layer can be placed between any one of those layers, preferably above the base or backing layer or between the wear layer and the UV top coat layer. Certainly, the barrier layer can even be located beneath the base or backing layer. Accordingly, the surface coverings described in U.S. Pat. No. 4,781,987 to Bolgiano et al. and U.S. Pat. No. 5,458,953, both incorporated herein by reference in their entirety, can be used in the present invention, and can be modified to include the barrier layer of the present invention.

The barrier layer of the present invention exhibits excellent barrier properties towards phthalate plasticizers, such as butyl benzyl phthalate and common stains existing in subflooring or underlayment such as moisture, dyes, markers, wood extractives and the like. The degree of flexibility of the barrier layer is not critical but the layer preferably should be flexible enough so that it will not crack during the winding up process in a production line. Accordingly, it is preferred that the barrier layer passes a 1 inch mandrel bend test when applied at a nominal dry film thickness of 1.2 mil over a flexible 25–30 mil underlying felt substrate, as described in U.S. Pat. No. 5,458,953, incorporated herein by reference in its entirety.

The barrier layer or coating of the present invention can also optionally contain pigments, or other additives, such as biocides. Any additions or pigments which do not substantially affect the barrier properties of the present invention, but provide additional features, can be used, such as $TiO_2$ to increase opacity, biocides to kill any organisms, and the like.

Figure 2:
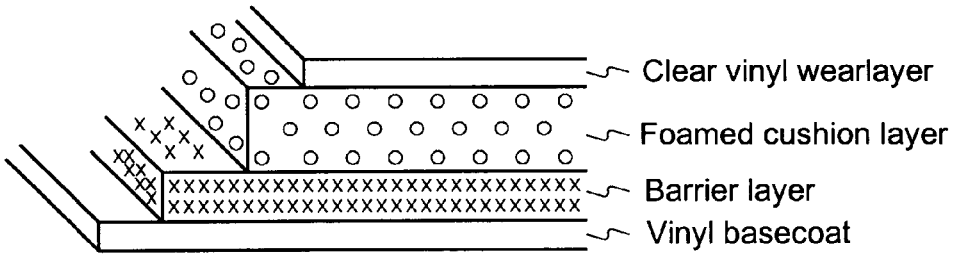
Figure 3:
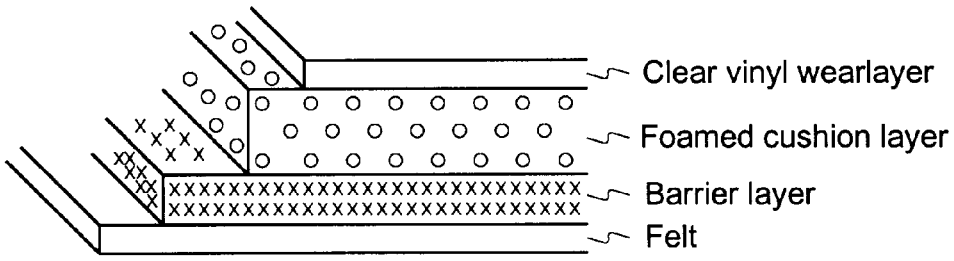

Furthermore, the barrier layer should have acceptable adhesion between the various other layers in a surface covering. The basic construction of a typical vinyl backed flooring is a release paper, a design layer, a base coat (vinyl composition), a foam-vinyl composition, a clear vinyl wear layer, and a top coat. Preferably, the barrier coat application is between the base coat and foam layer as shown in FIGS. 1 and 2. Therefore, the adhesion between the barrier coat and base coat and between the barrier coat and foam layer must be acceptable. Referring now to FIG. 1, there is illustrated in a cross-sectional view, a preferred resilient floor covering which is constructed according to the teachings of one preferred embodiment of the present invention and which is designated generally by reference numeral 11.

Covering 11 has a top surface 13 and a bottom surface 15. Covering 11 includes a resilient support surface 17, which is preferably laid out in substantially horizontal condition, is preferably a conventional substrate layer 21, a barrier layer 23, a foam layer 25, and a design layer 27.

Layer 21 is an optional substrate layer. It is useful as a controlled release layer after the structure 11 is stripped from a release paper layer in the manufacture of the floor covering of FIG. 1 and is also useful to provide improved adhesion in the final product installation.

Layer 21 is a conventional substrate layer known to those skilled in the art. Conventional substrate layer 21 comprises materials typical of substrate layers found in the flooring art, such as non-foamed, non-cross-linked, vinyl compositions, felted or matted fibrous sheet of overlapping, intertwined filaments and/or fibers, usually of asbestos or of natural, synthetic, or man-made cellulosic origin, such as cotton or rayon, although many other forms of sheets and films or textile materials, fabrics, or the like, may be used. It preferably comprises a polymerized non-cross-linked PVC composition or a felt material. The thickness of conventional substrate layer 21 is preferably 2 mils to 100 mils, more preferably from 5 mils to 15 mils.

A strengthening layer as described in U.S. Pat. No. 5,458,953 can optionally be disposed on top of and adhered to substrate layer 21 or can be the outermost bottom layer when substrate 21 is not used. If a strengthening layer is present, the barrier layer 23 is preferably disposed on the top of and adhered to the strengthening layer.

Disposed on top of and adhered to the barrier layer 23 is a substantially uniform layer 25 of a liquid or semi-liquid resinous composition which contains a synthetic polymeric material, usually an ungelled poly(vinyl chloride) plastisol normally containing a blowing or foaming agent. The liquid or semi-liquid plastisol vinyl resin composition of layer 25 is subsequently firmed or gelled at an elevated temperature to a relatively more stable condition by procedures which are conventional and well-known in the art. The thickness of foam layer 25 is preferably from about 10 mils to about 100 mils, more preferably from about 15 mils to about 40 mils.

Layer 27 is a design layer printed on foam layer 25. Layer 27 is an optional layer and it is not included if a design is not desired. The design layer can preferably be decorative, multi-color patterned, or design in which certain predetermined areas may contain a blowing or foaming inhibitor which subsequently modifies or alters the action of the blowing or foaming agent in those certain predetermined areas. Several different printing ink composition may be used in such procedures. The design layer can preferably be a gravure printed layer.

The design layer 27 is not necessarily a continuous layer. The design may only cover a portion of the underlying layer 25. In locations where there is no design layer, the wear surface 19 will therefore be adhered to foam layer 25.

Wear surface 19, as seen in FIG. 1, is applied to the top of and adhered to layer 27, and preferably comprises an initial wear layer 29, a wear layer base coat 31, and a wear layer top coat 33. Initial wear layer 29 is preferably a transparent poly(vinyl chloride) layer. Most PVC wear layers known in the art to be formulated for use on PVC resilient floor products would provide an adequate composition for this layer. The dry film thickness of this PVC layer 29 is preferably from about 5 mils to about 50 mils and more preferably from about 10 mils to about 20 mils.

The initial wear layer is an optional layer but is preferably used when a foam layer is present to provide adhesion between the foam layer and the wear layer base coat to provide smoothing of the upper surface of the blown foam layer and to control any chemical embossing. If an initial wear layer is not used, the wear layer base coat 31 should be adequately adhered to the underlying layer.

A wear layer base coat 31 is preferably applied to and adhered to initial wear layer 29 and is then cured or partially cured. The wear layer base coat can be cured by means known to those skilled in the art such as by ultraviolet light or thermal treatments.

Wear layer top coat 33 is preferably applied to the top of and adhered to the wear layer base coat 31 and is UV cured or both layers 31 and 33 are cured by the respective curing methods if wear layer base coat 31 was only initially partially cured.

In separate embodiments, both wear layers 31 and 33 can be absent or wear layer base coat 31 can be present and wear layer top coat 33 can be absent if the superior strengthening layer is present. In another embodiment, the superior strengthening layer can be absent and a conventional substrate layer can be used in its place if both the wear layer base coat 31 and wear layer top coat 33 are used.

To insure that the flooring composite exhibits the desired performance properties for its intended end use, each layer of the composite should exhibit adequate adhesion to the layer below and above it. The layers are generally adhered together by coating and curing each subsequent layer and/or by using an adhesive or bonding agent between layers to increase the adhesion. The initial wear layer 29 should adhere to the support surface 17 without any special treatment, when thermally fused to the support surface under conditions known to those skilled in the art of making PVC resilient floor coverings. Additional adhesion methods known to those skilled in the art can be used.

The barrier layer of the present invention should also have acceptable heat resistance and preferably is stable (dimensionally) during the fusion process which typically occurs at a temperature of about 190° C. to about 200° C. for about 2 minutes to about 4 minutes.

To show the excellent stain blocking properties of the present invention, experiments were conducted using two test procedures described below.

Test Procedure A

1. Three circular samples were cut out from the various commercial flooring products identified in Table 1 and Table 2 having a diameter of 1 and ⅛-inch for each sample.

2. A ⅛-inch inner diameter rubber O-ring was glued to the back of each sample using a fast curing adhesive (e.g., Duco cement) and fully cured for at least 2–3 hours.

3. An absorbent material roughly having the dimensions ⅛-inch×⅛-inch, such as wound dressing from a first-aid kit, was placed into the rubber O-ring using a pair of tweezers and packed tightly into the O-ring.

3. Using an eye dropper, two drops of stainant were placed into the absorbent material inside the O-ring.

4. The back side of the sample was then wrapped with a piece of aluminum foil and the samples were placed in an oven at 150°0 F.

5. The stain migration observed from the top clear wear layer was observed once a day to determine whether stain migration could be visually seen. The samples were then placed back into the oven and stain migration checked each day for a period of 14 days.

The following rating system was used for visually determining whether a stain could be seen from the top clear wear layer.

0: No stain

1: Trace

2: Slight

3: Moderate

4: Severe

The individual readings were recorded and, as reflected in Tables 1 and 2, the total stain readings were determined.

Test Procedure B

1. Five 2.5-inch×2.5-inch square samples were cut from the commercially available flooring products identified in Tables 1 and 2 for each sample to be tested.

2. Five stainants were used: black ink (b), hair dye (h), purple primer (p), driveway sealer (d), and shoe polish (s).

3. Small pieces of Kimwipe roughly having the dimensions 0.5-inch×0.5-inch were placed on the back of each sample and then one drop of stainant was applied to the absorbent pad using an eye dropper and each sample was wrapped with one piece of aluminum foil. Then, enough weight was placed on top of the aluminum foil with sample to exert 1.2 psi pressure on the sample.

4. For this test, it was determined that with the use of purple primer, no adsorbent pad was needed and the purple primer was directly added to the back side of the sample. The samples were then placed (with the weight still on sample) in an oven at 120°0 F. and examined once every two to three days and a visual determination was made whether stain migration could be seen from the top clear wear layer. The same rating system was used as described above for Test Procedure A and the test was stopped after 14 days.

EXAMPLE I

Vinyl Back Product With Barrier Coat a) Using 11 mils gauge release felt as a backing, 16 mils of the following basecoat was applied, and then cured at 390° F. for 75 seconds:

Basecoat Composition

| | Wt. % |
|---|---|
| Alkyl Benzyl Phthalate | 21.15% |
| TXIB | 2.84% |
| Aliphatic Hydrocarbon Wetting Agent | 2.81% |
| Stabilizer | 1.08% |
| Biocide | 5.02% |
| Calcium Carbonate | 20.63% |
| Dispersion Resin I.V. 1.2 | 18.65% |
| Blending Resin I.V. 0.89 | 24.18% |

b) Using a Myer rod #20, 2 mils (wet) of MP-508 (primer coating) was applied to the basecoat and then cured at 300° F. for 60 seconds. The dried film was 0.7 mils thick. The primer coating contained 78% by weight of EX-51224 (aliphatic polyurethane colloidal dispersion), 19.5% by weight of UE-41503 (water borne polyurethane based adhesive) and 2.5% by weight of AQ-7550 (melamine crosslinker) from Monsanto or KM-101671 from Stahl or Cymel 325 from Cytec. The primer served as an adhesion promoter between the vinyl basecoat layer and the polyamide barrier described below.

c) Using a Myer rod #20, a 2 mil polyamide coating was applied on top of the primer coating and then cured at 300° F. for 90 seconds. The cured coating was 0.3 mils thick. The polyamide coating was a 10% solid solution in ethanol and was EX-5031 from Stahl. The polyamide used was a polyamide co-polymer (DuPont's Elvamide), which is soluble in alcohol or an alcohol-water mixture. A water dispersed type polyamide such as Micromid 632 HPL from Union Camp can also be used to form the polyamide coating.

d) 20 mils of a foamable plastisol having the formula described below was applied on top of the polyamide coating and then cured at 390° F. for 30–40 seconds:

| | By Wt% |
|---|---|
| Alkyl Benzyl Phthalate | 11.53% |
| Secondary Plasticizer | 1.10% |
| TXIB | 2.19% |
| Aliphatic Hydrocarbon Wetting Agent | 5.2% |
| Premix | 10.79% |
| Biocide | 3.05% |
| Calcium Carbonate | 11.31% |
| Paste Resin I.V. 0.92 | 9.57% |
| Blending Resin I.V. 0.89 | 26.98% |

e) A Rotogravure printing process was used to apply a design and chemical inhibitor on the substrate described at (d).

f) Then, 20 mils of a wearlayer plastisol having a typical clear formula was applied on top and fused at 390° F. for 180 seconds.

EXAMPLE II

Felt Back Product With Barrier Coat a) Using 25 mils gauge felt as a backing, 2 mils wet waterbone polyurethane dispersion that contained, by weight, 94.5% Stahl 51224 (aliphatic polyurethane colloidal dispersion), 0.5% Stahl KM101610 surfactant, 1.0% Stahl KR1450 rheology modifier, 4% Cytec Cymel 325 crosslinking agent, and 0.1% BYK 024 wetting agent was applied with a Myer rod #20.

b) The substrate was then cured at 300° F. for 90 seconds. The coating thickness after drying was 0.7 mils.

c) Steps a) and b) were repeated until the coating thickness was 1.4 mils.

d) 9 mils of foamable plastisol having the formula described below was applied on top of the substrate and then cured at 390° F. for 30–40 seconds:

| | By Wt% |
|---|---|
| Alkyl Benzyl Phthalate | 11.53% |
| Secondary Plasticizer | 1.10% |
| TXIB | 2.19% |
| Aliphatic Hydrocarbon Wetting Agent | 5.2% |
| Premix | 10.79% |
| Biocide | 3.05% |
| Calcium Carbonate | 11.31% |
| Paste Resin I.V. 0.92 | 9.57% |
| Blending Resin I.V. 0.89 | 26.98% |

e) Then, 10 mils of a wearlayer plastisol having a typical clear formula was applied and fused at 390° F. for 180 seconds.

EXAMPLE III a) A barrier coating such as waterbase polyurethane or polyamide solution can be coated on top of vinyl wearlayer and underneath a polyurethane topcoating. This barrier serves as plasticizer barrier that blocks the diffusion of plasticizers moving from the wearlayer or other layers into the polyurethane topcoat. The aging effect due to the diffusion of plasticizer can deteriorate the stain resistance property of the polyurethane topcoat on vinyl floor coverings.

TABLE 1

Stain Migration Test Results

| | Gold | Sterling Flex | Silverado Flex | Omnia | Classic | Sterling Felt | Silverado Felt | Armstrong Vega II | Armstrong Tradition | Armstrong Select | Armstrong Visions | Armstrong DS | Congoleum Discover | Dumco Impulse | Tarkett Perfecta |
|---|---|---|---|---|---|---|---|---|---|---|---|---|---|---|---|
| Procedure A | | | | | | | | | | | | | | | |
| Blue Dye | 2 | 4 | 4 | 4 | 3 | 4 | 4 | 4 | 4 | 4 | 3 | 3 | 4 | 4 | 4 |
| BHT | 1 | 4 | 4 | 4 | 2 | 4 | 4 | 4 | 4 | 4 | 3 | 3 | 4 | 4 | 4 |
| Asphalt | 0 | 1 | 1 | 2 | 1 | 3 | 2 | 3 | 2 | 3 | 1 | 2 | 1 | 0 | 3 |
| Sub-total | 3 | 9 | 9 | 10 | 6 | 11 | 10 | 11 | 10 | 11 | 7 | 8 | 9 | 8 | 11 |
| Procedure B | | | | | | | | | | | | | | | |
| Black Ink | 0 | 0 | 0 | 0 | 0 | 0 | 0 | 0 | 0 | 0 | 0 | 0 | 0 | 0 | 0 |
| Hair Dye | 2 | 4 | 4 | 4 | 2 | 1 | 1 | 2 | 3 | 4 | 3 | 3 | 2 | 2 | 4 |
| Driveway Sealer | 0 | 3 | 3 | 3 | 3 | 1 | 0 | 2 | 1 | 3 | 1 | 0 | 1 | 0 | 4 |
| Purple Primer | 0 | 2 | 3 | 4 | 3 | 3 | 3 | 3 | 3 | 4 | 2 | 1 | 1 | 2 | 4 |
| Shoe Polish | 2 | 4 | 4 | 4 | 4 | 3 | 1 | 3 | 3 | 4 | 3 | 1 | 3 | 3 | 4 |
| Sub-total | 4 | 13 | 14 | 15 | 12 | 8 | 5 | 10 | 10 | 15 | 9 | 5 | 7 | 7 | 16 |
| TOTAL STRAIN RATINGS | 7 | 22 | 23 | 25 | 18 | 19 | 15 | 21 | 20 | 26 | 16 | 13 | 16 | 15 | 27 |

TABLE 2

| | Stain Migration Test Results | | | | | |
|---|---|---|---|---|---|---|
| | Sterling Flex | Sterling Flex with Barrier | Omnia | Omnia with Barrier | Vega II | Vega II with Barrier |
| | | | Procedure A | | | |
| Blue Dye | 4 | 0 | 4 | 0 | 4 | 1 |
| BHT | 4 | 0 | 3 | 0 | 4 | 0 |
| Asphalt | 2 | 0 | 1 | 0 | 3 | 1 |
| Sub-total | 10 | 0 | 8 | 0 | 11 | 2 |
| | | | Procedure B | | | |
| Black Ink | 0 | 0 | 1 | 0 | 2 | 2 |
| Hair Dye | 4 | 2 | 3 | 3 | 3 | 1 |
| Driveway Sealer | 3 | 0 | 3 | 0 | 1 | 0 |
| Purple Primer | 4 | 0 | 2 | 0 | 3 | 1 |
| Shoe Polish | 4 | 1 | 4 | 1 | 2 | 1 |
| Sub-total | 15 | 3 | 13 | 4 | 11 | 5 |
| TOTAL STAIN RATINGS | 25 | 3 | 21 | 4 | 22 | 7 |

As can be seen in Table 1, without a barrier layer, the various commercial products had high total stain ratings. When the barrier layer of the present invention was incorporated into several commercial products described in Table 2, the stain migration significantly dropped as shown in Table 2. The barrier coating used with the Sterling and Omnia products was the barrier coating described in Example I above. The barrier coating used with the Vega II was the barrier coating described in Example II above.

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A floor covering comprising a barrier layer for inhibiting the diffusion of stains therethrough comprising polyamide.

2. The floor covering of claim 1, wherein said barrier layer further comprises a pigment and/or biocide.

3. The floor covering of claim 1, wherein said barrier layer further comprises a cross-linker.

4. The floor covering of claim 1, wherein said barrier layer has a dry film thickness of from about 0.3 to about 3.0 mil.

5. The floor covering of claim 1, wherein said polyamide is applied as a polyamide solution in alcohol.

6. The floor covering of claim 1, wherein said polyamide is a copolymer.

7. The floor covering of claim 1, further comprising an adhesion promoter layer located above and beneath said barrier layer.

8. The floor covering of claim 7, wherein said adhesion promoter layer comprises a polyurethane dispersion.

9. The floor covering of claim 8, wherein said adhesion promoter layer further comprises a cross-linking agent.

10. The floor covering of claim 4, wherein said barrier layer comprising polyamide has a dry film thickness of from about 0.30 to about 0.60 mil.

* * * * *